US005159787A

United States Patent [19]

Suenaga et al.

[11] Patent Number: 5,159,787

[45] Date of Patent: Nov. 3, 1992

[54] METHOD FOR LAPPING TWO SURFACES OF A TITANIUM DISK

[75] Inventors: Hiroyoshi Suenaga; Takeshi Ito; Masakuni Takagi; Hiroyoshi Takeuchi; Hideaki Fukai; Kuninori Minakawa, all of Tokyo, Japan

[73] Assignee: NKK Corporation, Tokyo, Japan

[21] Appl. No.: 769,326

[22] Filed: Sep. 30, 1991

Related U.S. Application Data

[63] Continuation-in-part of Ser. No. 453,953, Dec. 20, 1989, abandoned.

[30] Foreign Application Priority Data

Jan. 20, 1989 [JP] Japan ..... 1-9692

[51] Int. Cl.[5] ..... B24B 37/04

[52] U.S. Cl. ..... 51/326; 51/281 SF; 51/131.3; 51/133; 156/636; 156/645

[58] Field of Search ..... 51/281 SF, 290, 131.1, 51/131.2, 131.3, 133, 134, 129, 326, 327, 318; 156/636, 645

[56] References Cited

U.S. PATENT DOCUMENTS

| | | | |
|---|---|---|---|
| 2,973,605 | 3/1961 | Carman et al. | 51/133 |
| 3,089,292 | 5/1963 | Hunt | 51/133 |
| 4,475,981 | 10/1984 | Rea | 156/636 |
| 4,593,495 | 6/1986 | Kawakami et al. | 51/131.3 |
| 4,645,561 | 2/1987 | Rea | 156/645 |

FOREIGN PATENT DOCUMENTS

| | | | |
|---|---|---|---|
| 0197214 | 10/1986 | European Pat. Off. . | |
| 0006294 | 2/1980 | Japan | 156/645 |
| 2-190243 | 7/1990 | Japan | 51/4 |

OTHER PUBLICATIONS

Polishing Technique for Titanium; Prochnow; Applied Optics vol. 23, No. 23, Dec. 1984.

"Titanium and Titanium Alloys, Source Book" a collection of articles, Titanium and its alloys, reprinted from Materials Engineering, 79-80, Jul. 1974, 61-7—, Reinhold Publishing Company, Inc.

*Primary Examiner*—Robert A. Rose

*Attorney, Agent, or Firm*—Frishauf, Holtz, Goodman & Woodward

[57] ABSTRACT

A method for lapping two surfaces of a titanium disk comprises inserting loosely a titanium disk to be lapped into an opening in a disk-type carrier, the carrier rotating and revolving between an upper surface plate and a lower surface plate which are held in parallel with each other and which applies lapping pressure to the titanium disk, feeding abrasives between the surface plates and the titanium disk and satisfying the following relationship between thickness t (mm) of the titanium disk and thickness T (mm) of the carrier:

$$0.025\ exp\ (t+1.5) \leqq T \leqq 0.9\ t$$

11 Claims, 2 Drawing Sheets

METHOD FOR LAPPING TWO SURFACES OF A TITANIUM DISK

This application is a continuation-in-part, of application Ser. No. 07/453,953, filed Dec. 20, 1989 abandoned.

BACKGROUND OF THE INVENTION

1. Field of the Invention

The present invention relates to a method for lapping two surfaces of a titanium disk or a titanium alloy disk used for a magnetic disk or the like by the use of abrasives.

2. Description of the Prior Arts

Since titanium and titanium alloy (hereinafter, simply referred to as "titanium") are good in cleanness and superior to aluminium and aluminium alloy (hereinafter, simply referred to as "aluminium") in heat resistance, they are very much expected to be used for a substrate of high-quality magnetic disk or the like. In the case of the magnetic disk, a high degree of flatness and smoothness of a surface thereof is required. Therefore, a technique of lapping titanium disk has been studied earnestly. There remain unsolved, however, problems in methods of lapping relative to the titanium disk which is very hard to process compared with aluminum alloy.

An aluminium substrate is generally lapped as follows: the aluminium disk to be lapped is put between two surface plates held in parallel with each other together with carrier in the state of being loosely inserted into an opening made in a disk-type carrier. A thickness of the carrier is smaller than that of the aluminium disk. Abrasives are fed into between the aluinium disk and said surface plate. Two surfaces of the aluminium disk are lapped by rotation and revolution of the carrier, a predetermined pressure being applied to the aluminium disk through the surface plates.

When this method of lapping, in which there are substantially not any problems in lapping of the aluminium disk, is applied to lapping of a titanium disk, since the titanium disk is not sufficiently held, the titanium disk can be damaged, having sprung out of the carrier, or when the titanium disk is reliably held, there can occur damages on the carrier due to resistance to lapping.

SUMMARY OF THE INVENTION

It is an object of the present invention to provide a method for lapping a titanium disk, wherein the titanium disk can be lapped with a small damage of the titanium disk (including titanium alloy. The same shall apply hereinafter.) and with high yield even in the case of lapping the titanium disk strong in resistance to lapping in a method of simultaneous lapping of two surfaces by the use of sliding surface plates wherein good flatness and surface roughness can be obtained.

To accomplish the above-mentioned object, the present invention provides a method for lapping two surfaces of a titanium disk comprising:

inserting loosely a titanium disk to be lapped into an opening in a disk-type carrier, said carrier rotating and revolving between an upper surface plate and a lower surface plate which are held in parallel with each other and which applies lapping pressure to the titanium disk;

feeding abrasives into among said surface disks and the titanium disk; and satisfying the following relationship between thickness t (mm) of said titanium disk and thickness T (mm) of said carrier:

$$0.025\exp(t+1.5) \leqq T \leqq 0.9t$$

The above objects and other objects and advantages of the present invention will become apparent from the detailed description which follows, taken in conjunction with the appended drawings.

DESCRIPTION OF THE PREFERRED EMBODIMENT

An example of the present invention will be described with specific reference to the appended drawings.

Figure 1:
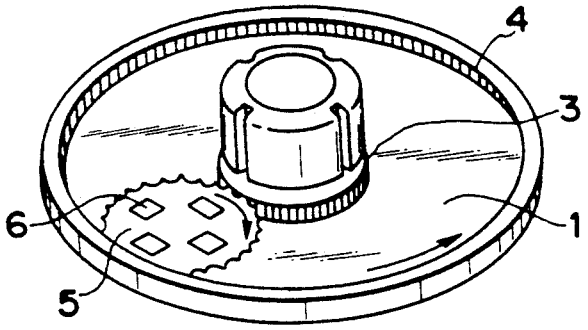
FIG. 1 is a perspective view illustrating a lapping portion of a lapping device which executes a method of the present invention.
Figure 2:
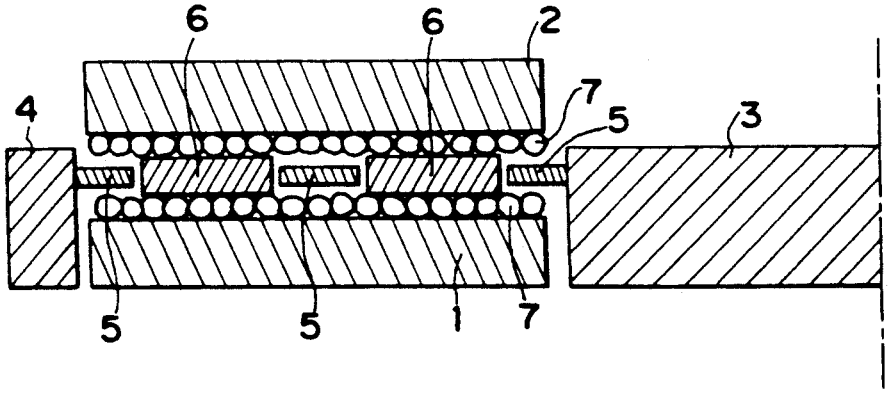
FIG. 2 is a vertical sectional view of the lapping portion in FIG. 1.

A main portion of a lapping device wherein the method of the present invention is used is shown in FIGS. 1 and 2. FIG. 1 is a perspective view illustrating a lapping portion. FIG. 2 is a vertical sectional view of the lapping portion taken on a radial line of FIG. 1. In the drawings, reference numeral 1 denotes a lower surface plate, 2 an upper surface plate, 3 a sun gear, 4 an internal gear, 5 a carrier, 6 a titanium disk and 7 abrasives. The titanium disk 6 is put between the lower surface plate 1 and the upper surface plate 2. The abrasives 7 are fed into among the titanium disk 6 and the surface plates 1 and 2. The titanium disk 6 is held in the state of being loosely inserted into an opening made in the carrier 5. The carrier 5 has a planet gear and is revolved by rotation of the sun gear 3 along the internal gear 4 and, at the same time, rotates. A lapping pressure is applied to the upper and lower surface plates in the upward and downward directions and the upper surface plate and lower surface plate can rotate independently, respectively. The titanium disk 6 is lapped by causing the lower plate 1 and upper plate 2 to rotate respectively in the reverse direction.

In the case of lapping a titanium disk with high hardness and ductility by the use of the foregoing lapping apparatus, resistance to lapping is very high compared with that in the case of lapping an aluminium disk. In consequence, in case a disk to be lapped is the titanium disk 6, the titanium disk can spring out of an opening of the carrier 5, in which the titanium disk is loosly inserted. When the titanium disk 6 has sprung out, the titanium disk 6 can be damaged and, at the same time, the carrier 5 can be damaged.

In order to prevent the titanium disk 7 from springing out, it is good to make the carrier 5 thick. However, as clearly seen from a structure of the lapping device, a thickness of the carrier 5 cannot be made larger than that of the titanium disk 6. The thickness of the titanium disk 6 is an upper limit of the thickness of the carrier 5 in terms of theory, but to prevent the carrier 5 from being damaged by lapping during lapping, the upper limit of the thickness of the carrier 5 is made smaller than that of the titanium disk 6.

Since two surfaces of the titanium disk, whose surfaces are made flat to some extent, are lapped in two-sided lapping at the start of the lapping, a decrease of the thickness of the titanium disk during lapping is small. Accordingly, in the case of studying a relative thickness of the titanium disk 6 in comparison with the thickness of the carrier 5, the decrease of the thickness of the titanium disk 6 can be ignored.

Particle sizes of the abrasives are made smaller from the start of the two-sided lapping to the end thereof. In an actual lapping process of the titanium disk 6, a plurality of lapping apparatuses are used and the particle sizes of the abrasives are determined depending on sorts of the lapping apparatuses. The titanium disk 6 is lapped with the abrasives whose particle sizes are changed by successively moving the titanium disk. When the thickness of the titanium disk 6 being the disk to be lapped is determined, the thicknesses of the carriers 5 set in a plurality of said lapping apparatuses are made definite in accord with the thickness of the titanium disk 6.

It is an object of the present invention to find an appropriate range of the thickness of the carriers 5 relative to the thickness of the titanium disk 6 on the basis of the foregoing conditions.

The thickness T of the carrier 5 relative to the thickness t of the titanium disk was determined by conducting the following test. The following were studied under lapping condition in the practical range of said t, T and sorts of abrasives. Cold-rolled titanium sheet of JIS 2 (corresponding to TP 35C of JIS-H-4600) was used. Said titanium sheets of 3 mm, 2 mm and 1 mm in thickness were blanked out into disks, each of which was of a diameter of 3.5 inches. Two surfaces of the disks were lapped simultaneously by the use of the lapping apparatus. And damages of the carriers 5 and a ratio of defects of the titanium disks were studied.

At a lapping step, the titanium disks were lapped in stages by making a roughness of the abrasives into 400, 800, 1500, 3000 and 4000 meshes in this order. Sorts of used abrasives were silicon carbide and alumina. Used carrier 5 was a carrier of 9 inches in diameter made of glass fibre which can hold two disks, each of which was of 3.5 inches in diameter and made of the titanium disk 6. The thickness of the carrier 5 was selected within the range of 0.15 to 2.8 mm. The lapping pressure was determined at 50 g/cm$^2$ and was maintained at this value. Damages of the carrier 5 were visually found. The ratio of defects of the titanium disk 6 is represented with a ratio of pieces of damaged titanium disks to 150 pieces of the titanium disks being tested in percentage.

The thickness of the titanium disk 6, the thickness of used carrier 5 and obtained results are shown in Table 1.

TABLE I

| Example | Nos. | Thickness of Disk (mm) | Thickness of Carrier (mm) | Damages of Carrier | Ratio of Damage of Titanium Disk (%) |
|---|---|---|---|---|---|
| Examples | 1 | 0.5 | 0.20 | None | 0 |
| | 2 # | 0.5 | 0.30 | None | 0 |
| | 3 | 0.5 | 0.45 | None | 0 |
| | 4 | 1.0 | 0.35 | None | 0 |
| | 5 | 1.0 | 0.50 | None | 0 |
| | 6 | 1.0 | 0.90 | None | 0 |
| | 7 | 2.0 | 0.85 | None | 0 |
| | 8 | 2.0 | 1.00 | None | 0 |
| | 9 # | 2.0 | 1.50 | None | 0 |
| | 10 | 2.0 | 1.80 | None | 0 |
| | 11 | 3.0 | 2.30 | None | 0 |
| | 12 # | 3.0 | 2.70 | None | 0 |
| | 13 | 3.0 | 2.50 | None | 0 |
| Controls | 1 | 0.5 | 0.15 | None | 21 |
| | 2 | 0.5 | 0.50 | Damaged | 0 |
| | 3 | 1.0 | 0.25 | None | 15 |
| | 4 # | 1.0 | 0.95 | Damaged | 0 |
| | 5 | 1.0 | 0.95 | Damaged | 0 |
| | 6 | 2.0 | 0.70 | None | 13 |
| | 7 # | 2.0 | 0.80 | None | 11 |
| | 8 | 2.0 | 1.85 | Damaged | 0 |
| | 9 | 3.0 | 2.20 | None | 9 |
| | 10 # | 3.0 | 2.75 | Damaged | 0 |
| | 11 | 3.0 | 2.80 | Damaged | 0 |

#; Abrasives of alumina were used. In other examples and controls, abrasives of silicon carbide were used.

Figure 3:
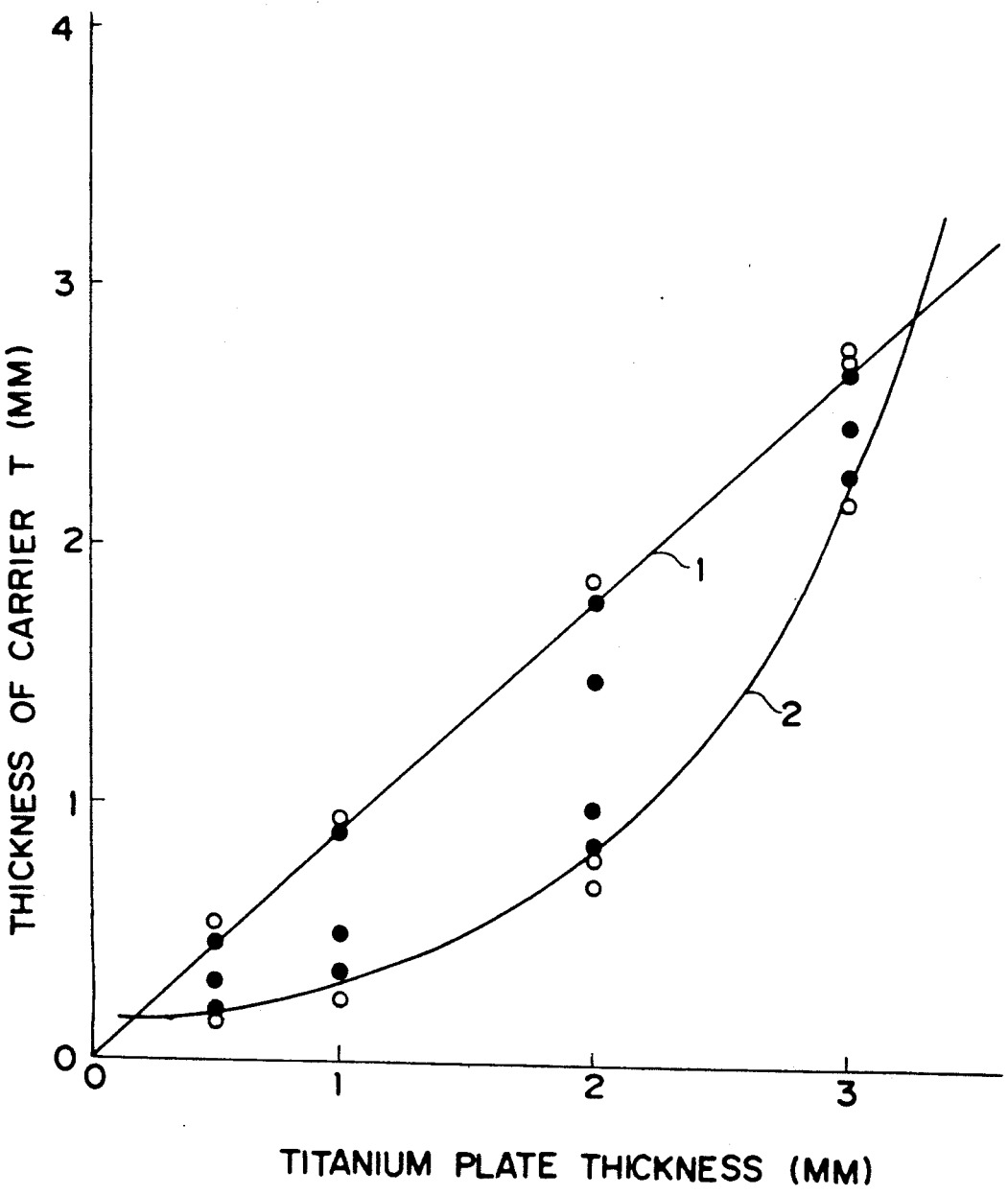
FIG. 3 is a graphical representation showing the relation between a thickness of a titanium disk and a thickness of a carrier of the example of the present invention.

In all the examples, damages of the carrier 5 were not observed. There was not any titanium disk which sprung out and was damaged. On the other hand, in controls, either damages of the carrier 5 or damages of the titanium disk 6 occurred. The results of Table 1 are represented with a graphical representation in FIG. 3. In FIG. 3, the thickness of the carrier 5 and the thickness of the titanium disk 6, each having been subjected to the tests, are represented with the axis of ordinate and the axis of abscissa, respectively, and the examples of the present invention are indicated with black circles and the controls of the present invention with white circles.

Firstly, the upper limit of the thickness of the carrier 5 can be determined within the range, in which fragments do not occur due to the damages produced by the carrier 5 during lapping of the titanium disk. When the fragments produced by breaking of a part of the titanium disk are included into the abrasives, the effect in lapping of the titanium disk is remarkably decreased. As shown in FIG. 3, the fragments due to the damages produced by lapping of the titanium disk by the use of the carrier 5 do not occur on the lower side of graph 1.

$$T=0.9t \tag{1}$$

Accordingly, it is understood that the limit of the thickness T of the carrier 5 is approximately 90% of the thickness t of the titanium disk 6. Graph 2 in FIG. 3 indicates the lowest limit of the thickness T of the carrier 5 relative to the thickness t of the titanium disk 6. And there is no damage of the titanium disk in positions above the graph 1

$$T=0.025\exp(t+1.5) \tag{2}$$

and the ratio of damages is zero.

When the relation between the thickness of the titanium disk 6 and the thickness of the carrier 5 which was found in the present invention is within a range enclosed with the graphs 1 and 2, any damage of the carrier 5 and the titanium disk does not occur. This condition can be represented with the following formula on the basis of the foregoing formulas (1) and (2):

$$0.025\exp(t+1.5)\leqq T\leqq 0.9t \tag{3}$$

Since a titanium disk has previously been lapped not only within the foregoing range, but also in the conditions of the controls in this case, either damages of the carrier 5 or breaking of the titanium disk 6 occur and the yield of the titanium disk 6 decreases.

In the present invention, the titanium disk can be prevented from springing out by controlling the thickness of the carrier 5. Glass fibre, cloth-inserted bakelite, vinyl chloride, steel, stainless steel and the like are used as materials for the carrier 5, but the foregoing formula (3) can apply even when materials are changed.

The same can be said relative to the abrasives 7. Even though the sorts or shapes of the abrasives are changed, the foregoing formula (3) can apply. Further, the same can be said not only in case the surface plates 1 and 2 and the carrier rotate, but also in case they carry out a linear reciprocating motion or other motions.

According to the present invention, since the thickness of the carrier 5 is controlled in accord with the thickness of the titanium disk 6 in lapping of the titanium plate, the carrier 5 is not damaged. Accordingly, fragments do not affect the lapping and, at the same time, the titanium disk 6 cannot spring out of the carrier 5. In consequence, a constant effect of the lapping can be stably obtained and this increases the yield.

Because the titanium disk is prevented from springing out of the carrier, a roughness indicated by a maximum height "R max" can be lapped stably on a mirror surface of 0.1 μm or less. This maximum height "R max" is a length represented by "μm" and is the difference between the highest point and the lowest point of the standard section of the test material.

According to this method of lapping, however, small damage still occurs. This small damage is due to the burying or dropping of the abrasives during the manufacturing process. Therefore it is desirable to achieve lapping by which a surface roughness of "R max" of 0.05 μm or less can be obtained.

Thus, after the titanium disk is lapped by the abrasives which have been fed between the surface plates, the lapped titanium disk is etched chemically and then the etched titanium disk is further lapped by a water solution containing colloidal $Al_2O_3$.

The lapping depth effected by the lapping is preferably 0.05 μm or deeper. This is because if the lapping depth is deeper than 0.05 μm, the abrasives buried or dropped in the titanium disk can be removed.

The chemical etching can be performed with any solution generally used for etching. For example, a solution comprising hydrofluoric nitric acid 5 volume %, HF 35 volume %, and $HNO_3$ 60 volume % can be used.

It is preferable that the final lapping be performed with colloidal $Al_2O_3$ having particles of size of 0.03 μm or less to prevent the occurrence of large damage.

Chemical etching and final lapping were performed using Example No. 1 and Control No. 2 shown in Table 1.

In the following Table 2, the surface roughness is shown when etching depth and particle size of colloidal $Al_2O_3$ are varied.

Since in Examples No. 2(a) through (d) shown in Table 2 the thickness t of the titanium disk and the thickness T of the carrier do not satisfy the relationship $0.025 \exp(t+1.5) \leqq T \leqq 0.9\ t$, a desirable surface roughness was not obtained. But since in Examples No. 1(h) and (l) shown in Table 2 the etching depth is 0.05 μm or more and the particle size of $Al_2O_3$ is 0.03 μm or less, a good surface roughness of 0.05 μm is attained.

The effect of the present invention is to achieve excellent lapping of previously hard to process titanium disks, and is of great practical use.

TABLE 2

| Sample | Test No. | Etching Depth | Particle Size of Coloidal $Al_2O_3$ | Surface Roughness $R_{MAX}$ (μm) |
|---|---|---|---|---|
| Example No. 1 | (a) | — | 0.08 | 0.09 |
| | (b) | — | 0.03 | 0.09 |
| | (c) | 0.02 | 0.05 | 0.09 |
| | (d) | 0.02 | 0.03 | 0.09 |
| | (e) | 0.04 | 0.08 | 0.08 |
| | (f) | 0.04 | 0.03 | 0.08 |
| | (g) | 0.05 | 0.05 | 0.06 |
| | (h) | 0.05 | 0.03 | 0.05 |
| | (i) | 0.07 | 0.05 | 0.06 |
| | (j) | 0.07 | 0.03 | 0.04 |
| Control No. 2 | (a) | — | 0.08 | 2.3 |
| | (b) | — | 0.03 | 3.4 |
| | (c) | 0.07 | 0.05 | 2.2 |
| | (d) | 0.07 | 0.03 | 2.0 |

What is claimed is:

1. A method for lapping two surfaces of a titanium disk, comprising the steps of:

inserting loosely a titanium disk into an opening of a disk-type carrier, said carrier rotating and revolving between an upper surface plate and a lower surface plate which are held parallel to each other and which apply pressure to said titanium disk;

performing a first lapping step by feeding abrasives between said surface plates and said titanium disk;

etching chemically the titanium disk; and performing a second lapping step by feeding a water solution containing colloidal $Al_2O_3$ between said surface plates and said titanium disk;

said titanium disk having a thickness t(mm) and said carrier having a thickness T(mm) such that $0.025 \exp(t+1.5) \leqq T \leqq 0.9\ t$.

2. The method of claim 1, including selecting the carrier from the group consisting of glass fiber, cloth-inserted bakelite, vinyl chloride, steel and stainless steel.

3. The method of claim 1, including selecting the abrasives from the group including silicon carbide and alumina.

4. The method of claim 1, including maintaining a lapping pressure of about 50 g/cm$^2$.

5. The method of claim 1, including lapping the titanium disk in stages over which the roughness of the abrasives is set at increasing mesh values.

6. The method of claim 5, including setting the roughness of the abrasives for successive lapping stages at 400, 800, 1500, 3000 and 4000 meshes in the stated order.

7. The method of claim 1, wherein said step of etching chemically the titanium disk includes etching the titanium disk with a solution comprising hydrofluoric nitric acid, HF and $HNO_3$.

8. The method of claim 1, wherein said step of etching chemically the titanium disk includes etching the titanium disk deeper than 0.05 μm in depth.

9. The method of claim 1, wherein said colloidal $Al2O_3$ has particles of 0.03 μm or less in particle size.

10. The method of claim 1, wherein said titanium disk has a thickness of 0.5 mm to 3. mm and said carrier has a thickness of 0.2 mm to 2.7 mm.

11. The method of claim 1, wherein:

said step of etching chemically the titanium disk includes etching the titanium disk deeper than 0.5 μm in depth;

said colloidal $Al2O_3$, has particles of 0.03 μm or less in particles size; and said carrier has a thickness of 0.2 mm to 2.7 mm.

* * * * *